United States Patent [19]

Kime

[11] Patent Number: 4,491,363

[45] Date of Patent: Jan. 1, 1985

[54] COMBINATION FOLDABLE TABLE AND BENCH UNIT

[76] Inventor: James W. Kime, 95 Moonglow Dr., Birmingham, Ala. 35215

[21] Appl. No.: 396,886

[22] Filed: Jul. 9, 1982

[51] Int. Cl.[3] ..... A47B 85/04

[52] U.S. Cl. ..... 297/126; 297/173

[58] Field of Search ..... 297/124, 125, 126, 119, 297/173; 292/95, 101; 24/17 B, 20 R, 53 M, 698

[56] References Cited

U.S. PATENT DOCUMENTS

| | | | |
|---|---|---|---|
| D. 178,611 | 8/1956 | Mickelson | 297/125 X |
| 1,532,417 | 4/1925 | Letts | 297/126 |
| 1,792,737 | 2/1931 | Greenstreet | 297/124 |
| 1,890,129 | 12/1932 | Ross | 297/126 X |
| 2,557,595 | 6/1951 | Bujjoni | 297/126 |
| 2,900,009 | 8/1959 | Haynes | 297/126 |

FOREIGN PATENT DOCUMENTS

| | | | |
|---|---|---|---|
| 1581 | of 1912 | United Kingdom | 24/33 M |

*Primary Examiner*—William E. Lyddane
*Assistant Examiner*—Peter R. Brown
*Attorney, Agent, or Firm*—Woodford R. Thompson Jr.

[57] ABSTRACT

A combined foldable table and bench unit embodies a pair of elongated seats arranged in parallel, spaced relation to each other. Transverse, vertically extending frame supports mounted adjacent the ends of each seat support the seats above a supporting surface. An arm is pivotally connected at one end thereof to an upper front portion of each frame support. The arms are adapted for pivotal movement selectively to a rearwardly extending horizontal position and to a vertical position. A back support member extends between and is carried by the other ends of the arms of each elongated seat. When the arms extend rearwardly and horizontally, the back support members carried thereby extend vertically and define facing benches. When the arms are pivoted to their vertical positions, the back support members are pivoted to a horizontal position with adjacent portions thereof in abutting relation with each other to define a table at an elevation above the seats. A releasable connector member carried by each back support member detachably connects the adjacent portions of the back support members to each other.

2 Claims, 7 Drawing Figures

Fig. 5
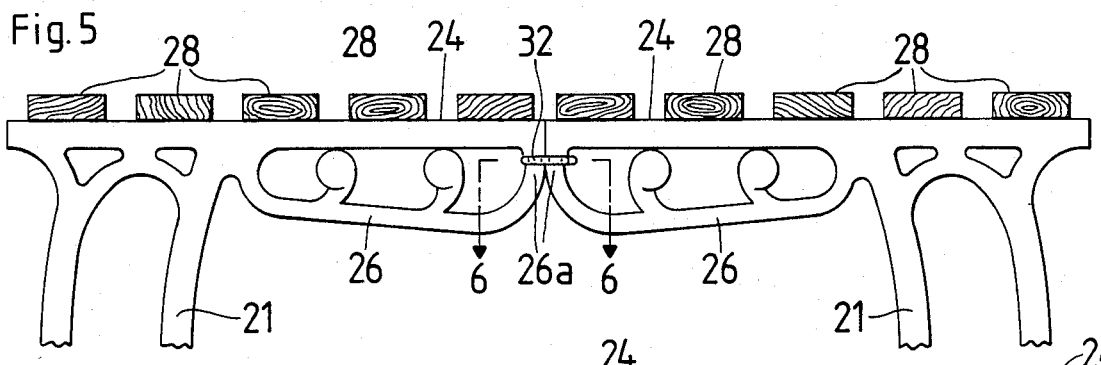
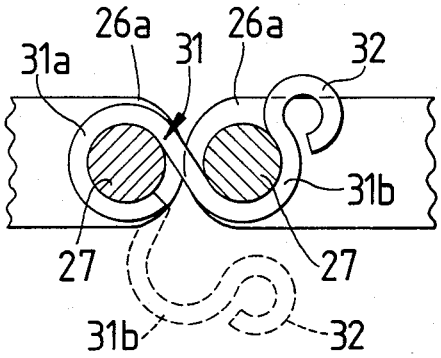
Fig. 6
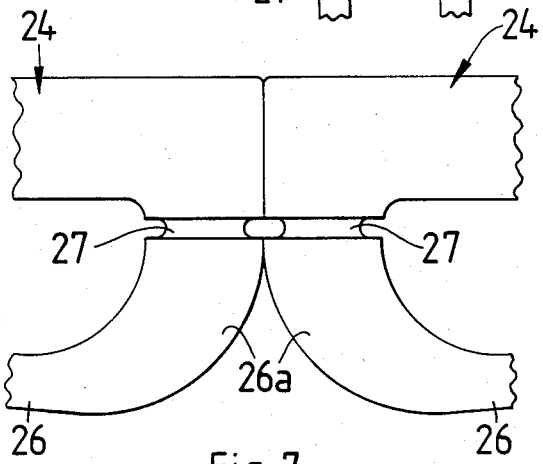
Fig. 7
Fig. 4
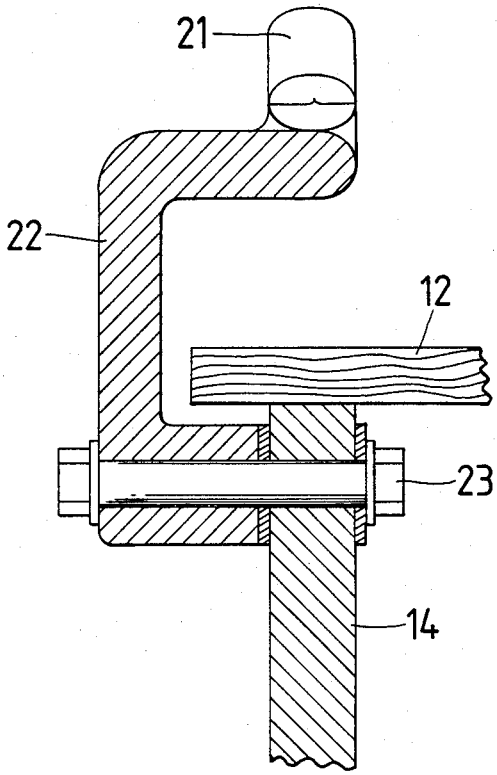

COMBINATION FOLDABLE-TABLE AND BENCH UNIT

BACKGROUND OF THE INVENTION

This invention relates to an improved combination foldable table and bench unit which may be quickly and easily converted selectively to a table having adjoining seats or to spaced apart facing benches.

Heretofore in the art to which my invention relates, many combination furniture units have been proposed which serve both as a table having adjoining seats or separate bench units. Such combination units are usually employed as patio furniture and picnic tables in situations where sufficient room does not permit a separate table and bench unit to be used. Difficulties have been encountered with such conventional units when converted from a chair or bench to a segment of a table. That is, a child or other unobservant person's hands or fingers oftentimes is injured when adjacent table segments are placed in abutting relation with each other to form a table. Also, movement of the abutting ends of the table segments relative to each other create unsafe conditions which may cause the items on the table to spill or turn over and may cause injury to persons at the sides of the table adjacent the abutting ends.

SUMMARY OF THE INVENTION

In accordance with my present invention, I overcome the above and other difficulties by providing an improved combination foldable table and bench unit which is simple of construction and economical of manufacture.

An object of my invention is to provide means which permits the combination unit to be converted with a minimum effort and without the use of any tools or wrenches selectively to a table having abutting table segments and to spaced apart benches having facing back support members.

Another object of my invention is to provide means for connecting the abutting table segments to each other so that injuries and spills caused by movement of the table segments relative to each other is eliminated.

My improved combination foldable table and bench unit comprises a pair of elongated seat-like members arranged in parallel spaced apart relation to each other with the front sides of the seat-like members facing each other. Transverse, vertically extending frame supports are mounted adjacent each end of each seat-like member for supporting the seat-like members above a supporting surface. An arm is pivotally connected at one end thereof to an upper front portion of each frame support and is adapted for pivotal movement selectively to a rearwardly extending, generally horizontal position and to a generally vertical position. A back support member extends between and is carried by the other ends of the arms of each seat-like member. Each back support member is adapted to extend upwardly in a generally vertical position when its arms extend rearwardly in their horizontal positions. Each back support member also extends in a horizontal position when its arms extend upwardly in their vertical positions. When the back support members are in their horizontal positions, adjacent portions thereof are in abutting relation with each other to define a table extending in a horizontal plane at an elevation above the seat-like members. A releasable connector member is carried by each back support member for detachably connecting the adjacent portions of the back support members to each other when in their horizontal table forming positions.

DESCRIPTION OF THE DRAWINGS

A table and bench unit embodying features of my invention is illustrated in the accompanying drawings, forming a part of this application, in which:

FIG. 4 is an enlarged fragmental sectional view taken generally along the line 4—4 of FIG. 1;

FIG. 5 is an enlarged fragmental side elevational view corresponding to FIG. 1 showing the table formed by the back support members in their horizontal positions;

FIG. 6 is an enlarged horizontal sectional view taken generally along the line 6—6 of FIG. 5; and FIG. 7 is an enlarged view showing the abutting end portions of the back support members when in their horizontal table forming positions.

DETAILED DESCRIPTION

Figure 1:
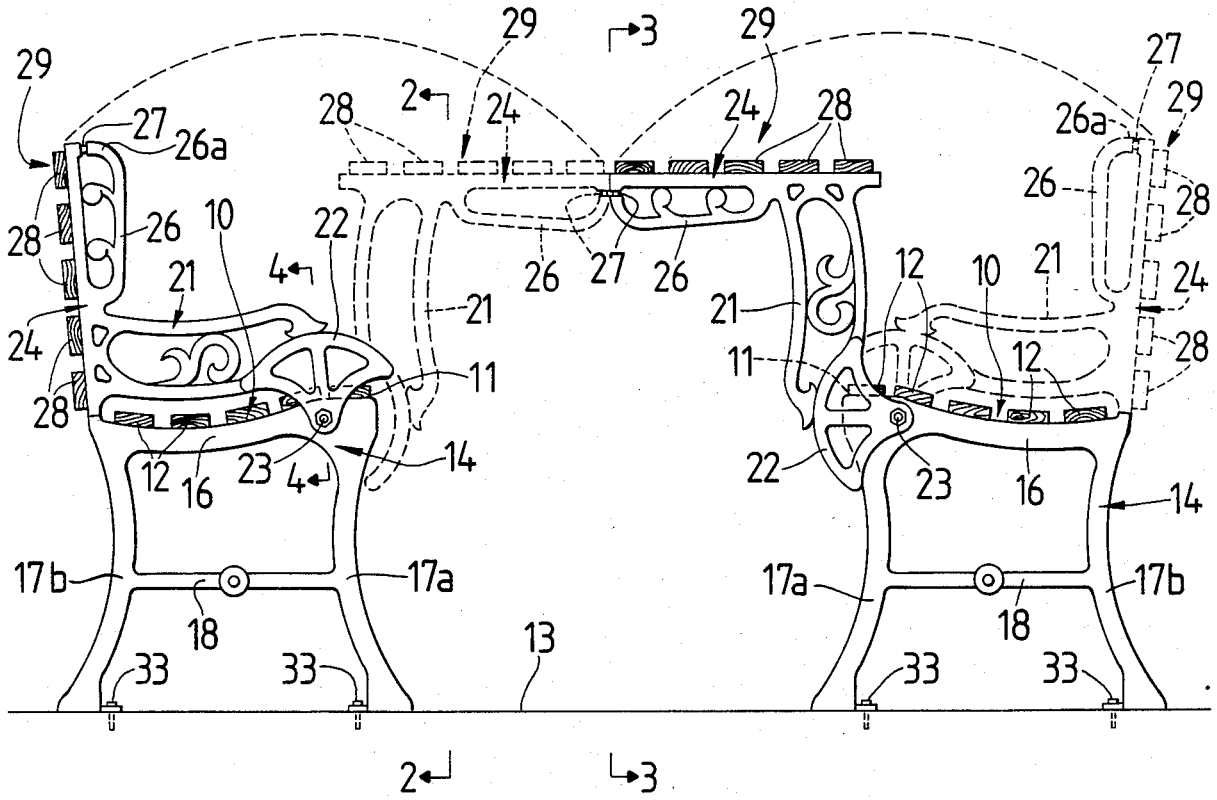
FIG. 1 is an end elevational view showing my improved foldable table and bench unit.
Figure 2:
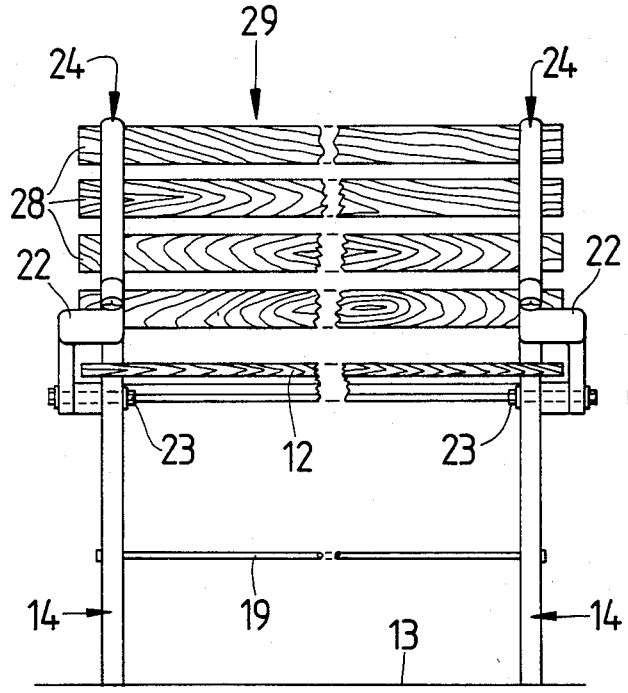
FIG. 2 is a vertical side elevational view taken generally along the line 2—2 of FIG. 1.
Figure 3:
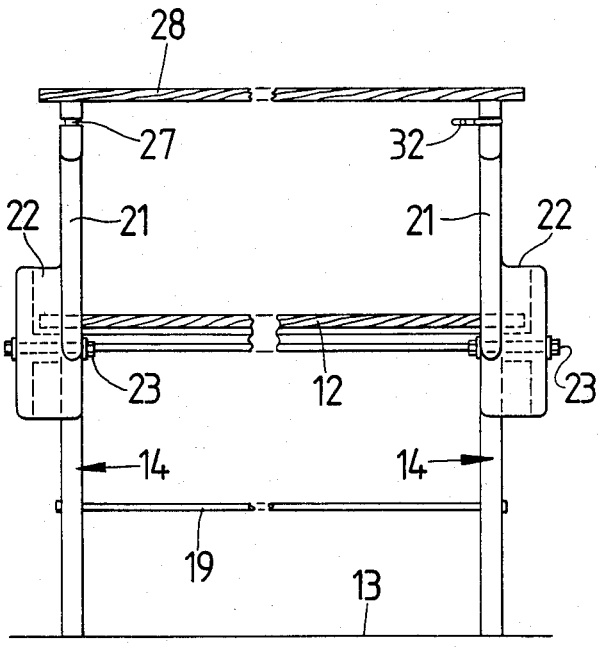
FIG. 3 is a vertical side elevational view taken generally alone the line 3—3 of FIG. 1.

Referring now to the drawings for a better understanding of my invention, I show in FIG. 1 a pair of elongated seat-like members 10 which are arranged in parallel, spaced apart relation to each other with the front sides 11 of the seat-like members facing each other. Preferably, each seat-like member 10 is constructed from a plurality of elongated laterally spaced wooden slats 12 which are supported above a supported surface 13 by transverse, vertically extending frame supports 14 adjacent the ends thereof, as shown in FIGS. 2 and 3. Each frame support 14 is preferably formed from a generally inverted U-shaped member having a base 16 and a pair of depending legs **17*a* and 17*b***.

As shown in FIG. 1, a horizontal member 18 extends between the mid portions of the legs **17*a* and 17*b* of each frame support 14. The horizontal members 18 provide additional bracing for each seat-like member 10. As shown in FIGS. 2 and 3, an elongated rod-like member 19 extends between the horizontal members 18. The rod-like members 19 provide means for bracing the seat-like members 10** against longitudinal movement.

An arm 21 having an offset arcuate end portion 22 extends across the end portions of each seat-like member 10. The offset end portion 22 of each arm support member 21 is pivotally connected by a pin 23, to an upper front portion of the adjacent transverse frame support 14 to provide a hinge having an open space between the arm 21 and the seat 10 which prevents injury to fingers. Each arm 21 is adapted for pivotal movement selectively to a rearwardly extending, generally horizontal position and to a generally vertical position. Formed integrally with and extending laterally from the other end portion of each arm 21 is a back support bracket 24. Each bracket 24 includes a laterally projecting member 26 which has an annular groove 27 adjacent one end portion **26*a* thereof, as shown. A plurality of back support elements, such as elongated wooden slats 28 extend between and are carried by the back support brackets 24 of each seat-like member 10, as indicated generally at 29 in FIGS. 1 and 2**.

The arms 21 of the seat-like members 10 are adapted to extend rearwardly in their generally horizontal positions whereby the back support members carried thereby extend upwardly in a generally vertical position to define spaced apart facing bench-like members, as shown in FIG. 1. When the arms 21 of the seat-like members 10 are pivoted to their vertical positions, the back support members 29 carried thereby extend horizontally at elevations above the seat-like members 10 into abutting relation with each other, as shown. That is, the back support members 29 extend horizontally in a common horizontal plane at an elevation above the seat-like members 10 with the end portions 26*a* of the back support brackets 24 being aligned and in abutting relation with each other to define a table at an elevation above the seat-like members 10. In this position, the center of gravity of each seat-like member 10 and its back support member 29 is spaced rearwardly from the pivotal connection of its arms 21 to the adjacent frame support 14 whereby the back support members 29 will always remain in a horizontal position relative to the supporting surface 13 while in the table forming position. In other words, the location of the center of gravity of each seat-like member 10 and its back support member 29 will prevent the seat-like member from turning over when the back support member is pivoted to its horizontal, table forming position.

As shown in FIG. 7, when the back support brackets 24 are in abutting relation with each other, the annular grooves 27 of the laterally projecting members 26 are aligned with each other. A generally S-shaped connector member 31 is adapted to rigidly connect the aligned grooves 27 to each other. That is, the connector member 31 has one end portion 31*a* which is adapted to engage one of the aligned grooves 27 and pivot relative thereto selectively to a first position with its other end portion 31*b* engaging, with a friction fit, the other aligned groove 27 and to a second position with the end portion 31*b* being disengaged from the adjacent aligned groove, as shown in solid and dotted lines, respectively, in FIG. 6. A handle 32 is carried by each connector member 31 to facilitate pivotal movement thereof to the first and second positions, as shown.

To further limit downward pivotal movement of each back support member 29 when pivoted to its horizontal, table forming position, the offset end portion 22 of the arms 21 are in position to engage the depending leg 17*a* of the adjacent transverse frame support 14, as shown in FIG. 1. This arrangement provides a positive stop for the back support member 29 which retains the brackets 24 in their horizontal table forming positions.

As shown in FIG. 1, suitable anchors 33 may be employed to secure the lower ends of the legs 17*a* and 17*b* of each transverse frame support 14 to the supporting surface 13. This will maintain the seat-like members 10 in proper spaced relation relative to each other and permit pivotal movement of the back support members 29 to their aligned horizontal, table-forming position. However, as described above, the location of the center of gravity of each seat-like member 10 and its back support member 29 when pivoted to its table forming position, will prevent the entire unit from turning over.

From the foregoing description, the operation of my improved combined foldable table and bench unit will be readily understood. With the seat-like members 10 laterally spaced from each other and the back support members 29 in their vertical positions, a table may be formed by simply pivoting the arms 21 from their horizontal positions to their vertical positions, as shown in FIG. 1. This pivots the back support members 29 to their horizontal positions and the back support brackets 24 into abutting relation with each other, as shown. Also, the offset end portions of the arms 21 engage the depending legs 17*a* of the adjacent transverse frame supports 14 to provide a positive stop for each back support member 29 when it is pivoted to the horizontal position. The connector member 31 carried by each back support member 29 is then pivoted from its second, disengaged position, shown in dotted lines in FIG. 6, to its first position in engagement with the adjacent annular groove 27 as shown in solid lines in FIG. 6. This rigidly connects the aligned, back support members 29 to each other.

To form facing bench-like members from the rigidly connected back support members 29, the steps described above are generally reversed. That is, the connector members 31 are pivoted from their first positions in engagement with the adjacent annular grooves 27 to their second positions out of engagement with the adjacent annular grooves 27. The back support members 29 are then pivoted from their horizontal positions to their generally vertical positions, as shown in FIG. 1.

From the foregoing, it will be seen that I have devised an improved combination foldable table and bench unit which may be quickly and easily converted selectively to a table having adjoining seats or to spaced apart facing benches. By providing detachable connector members which rigidly secure the back support members to each other while in their horizontal positions, I eliminate spills and injuries caused by movement of the back support members relative to each other. Also, by providing hinge connections having open spaces between the offset end portions of the transversely extending arms and the seat-like members, I eliminate injuries to fingers heretofore caused by the pivotal movement of conventional hinges employed with prior art combination foldable table units. Furthermore, by providing a positive stop which limits downward pivotal movement of each back support member when in its horizontal position, I provide means for maintaining the back support members in alignment with each other.

While I have shown my invention in but one form, it will be obvious to those skilled in the art that it is not so limited, but is susceptible of various changes and modifications without departing from the spirit thereof.

What I claim is:

1. In a combined foldable table and bench unit having a pair of elongated seat-like members arranged in parallel, spaced apart relation to each other with the front sides of said seat-like members facing each other, the improvement comprising, (a) transverse, vertically extending frame supports mounted adjacent each end of said seat-like member for supporting said seat-like member above a supporting surface, (b) an arm pivotally connected at one end thereof to an upper front portion of each said frame support and adapted for pivotal movement selectively to a rearwardly extending, generally horizontal position and to a generally vertical position, (c) a back support member extending between the other ends of said arms of each said seat-like member and having a laterally extending back support bracket formed integrally at one end with each of said other ends of said arms with each said back support member extending upwardly in a generally vertical position while its arms extend rearwardly in said horizontal position and with each said back support member extending in a horizontal position while its arms extend upwardly in said vertical position with adjacent portions of said back support members in abutting relation with each other to define a table extending in a horizontal plane at an elevation above said seat-like members, (d) a laterally projecting member carried by the other end of each said back support bracket with adjacent laterally projecting members being in alignment with and in abutting relation with each other when said back support members are in said horizontal position, (e) there being aligned annular grooves in said adjacent laterally projecting members, (f) a connector member adapted to rigidly connect said adjacent laterally projecting members to each other with one end portion of said connector member being of a shape to engage one annular groove of said aligned annular grooves and pivot relative thereto selectively to a first position with its other end portion engaging with a friction fit the other annular groove of said aligned annular grooves and to a second position with said other end portion of said connector member disengaged from said other annular groove; and (g) cooperating stop means between said arms and said frame supports limiting downward pivotal movement of each said back support member while in said horizontal position.

2. A combined foldable table and bench unit as defined in claim 1 in which said connector member is a generally S-shaped member.

* * * * *